US008709210B2

(12) United States Patent
Erkkilä et al.

(10) Patent No.: US 8,709,210 B2
(45) Date of Patent: Apr. 29, 2014

(54) METHOD AND ARRANGEMENT FOR FIBER WEB MACHINE, AND SOFTWARE PRODUCT

(71) Applicant: Metso Paper, Inc., Helsinki (FI)

(72) Inventors: Kari Erkkilä, Palokka (FI); Pekka Hilden, Säynätsalo (FI)

(73) Assignee: Valmet Technologies, Inc., Espoo (FI)

( * ) Notice: Subject to any disclaimer, the term of this patent is extended or adjusted under 35 U.S.C. 154(b) by 0 days.

(21) Appl. No.: 13/676,565

(22) Filed: Nov. 14, 2012

(65) Prior Publication Data

US 2013/0118701 A1 May 16, 2013

(30) Foreign Application Priority Data

Nov. 15, 2011 (FI) ..... 20116135

(51) Int. Cl.
*D21F 1/32* (2006.01)

(52) U.S. Cl.
USPC ..... 162/199; 162/272

(58) Field of Classification Search
USPC ..... 162/272, 199, 281, 280, 261, 209, 262
See application file for complete search history.

(56) References Cited

U.S. PATENT DOCUMENTS 3,013,606 A 12/1961 Goddard
5,403,447 A * 4/1995 Jarvinen et al. ..... 162/358.1
5,776,309 A * 7/1998 Fraik ..... 162/198
6,780,284 B2 * 8/2004 Almi et al. ..... 162/198
7,429,310 B2 * 9/2008 Heikkila et al. ..... 162/197

FOREIGN PATENT DOCUMENTS

FI 100412 B1 11/1997
FI 1117398 B1 9/2006
FI 118925 B1 5/2008
WO 2006087428 A1 8/2006
WO 2008040850 A1 4/2008

OTHER PUBLICATIONS

Search Report for FI20116135.

* cited by examiner

*Primary Examiner* — Mark Halpern
(74) *Attorney, Agent, or Firm* — Stiennon & Stiennon

(57) ABSTRACT

The invention relates to a method in a fiber web machine. In the method, a fabric (12) included in the fiber web machine is used for supporting a web (14) produced by the fiber web machine. Moreover, in the method the location of the fabric (12) is changed in the cross direction (CD) of the fiber web machine. The location is changed by means of oscillation, the amplitude (19) of which is kept so high that the area of impact (20) of the web (14) on the fabric (12) is wider than the width (21) of the web (14) throughout the lifetime of the fabric (12). The invention also relates to an arrangement in a fiber web machine, and to a software product.

13 Claims, 2 Drawing Sheets

METHOD AND ARRANGEMENT FOR FIBER WEB MACHINE, AND SOFTWARE PRODUCT

CROSS REFERENCES TO RELATED APPLICATIONS

This application claims priority on Finnish App. No. FI 20116135, Filed Nov. 15, 2011, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method in a fiber web machine, in which method a fabric included in the fiber web machine is used for supporting a web produced by the fiber web machine, and in which method the location of the fabric is changed in the cross direction of the fiber web machine. The invention also relates to a method in a fiber web machine and to a software product.

In prior art, the fabrics of a fiber web machine are oscillated at a constant amplitude, or there is no oscillation at all. In the press section of the fiber web machine, the fabrics are press felts, which pass through at least one press nip. In oscillation, the fabric is run in the cross direction of the machine for example by means of one guide roll. In other words, the location of the fabric in the cross direction of the fiber web machine changes. The purpose of this is, for example, to prevent the uneven wear of the rolls that support the fabric. The guide roll is moved by means of actuators, which are provided with control devices to accomplish a motion of desired magnitude. In addition to the press section, fabrics can also be oscillated in the forming section which precedes the press section, and in the drying section which follows the press section. Irrespective of the application, at least some portion of the travel of the fabric supports the web produced by the fiber web machine.

In practice, the width of the fabric varies on the basis of the running situation, and the fabric also shifts in the cross direction of the fiber web machine. In other words, the location of the fabric with respect to the center line of the fiber web machine can vary. In addition, especially the press felt is deformed as it passes through the press nip. In this case, when the fabric is oscillated, but also without oscillation, there can be a random problem. In this problem, the edges of the web occasionally go to such an area of the fabric where the web has never been before or where the web has not been for a long period of time. The properties of an area which has not been used or which has been unused for a long period of time are different from the remaining areas of the fabric. In this case, a point of discontinuity is formed at the edges of the fabric, and the edge of the web is damaged on such a point of discontinuity. Especially in the press section, edge damage often results in a web break sooner or later.

SUMMARY OF THE INVENTION

The purpose of the present invention is to provide a fiber web machine with a new type of method capable of avoiding the above-mentioned problem. Another purpose of the invention is to provide a fiber web machine with a new type of arrangement, which is suitable for different kinds of fabrics and which works despite changes taking place in the fabric or in the fiber web machine. Yet another purpose of the invention is to provide a new type of software product, which is suitable for various kinds of fiber web machines and which can be used for controlling a change in the location of the fabric. The characteristic features of the method according to the invention are that the location of the fabric is changed by means of oscillation, the amplitude of which is kept so high that the area of impact of the web on the fabric is wider than the width of the web throughout the lifetime of the fabric. Correspondingly, the characteristic features of the arrangement according to the invention are that the control devices are arranged to operate the actuators in an oscillating manner, and the oscillation amplitude is arranged to be kept so high that the area of impact of the web on the fabric is wider than the width of the web throughout the lifetime of the fabric. The method according to the invention prevents the edge of the web from hitting a point of discontinuity. Moreover, it may even be possible to prevent the formation of a point of discontinuity, or at least its difference from the rest of the fabric can be reduced. This makes it possible to avoid damage at the edge of the web, and thus avoid web breaks. The arrangement is simple and it works reliably without complex installations. The software product can be integrated easily into existing fiber web machines and actuators.

BRIEF DESCRIPTION OF THE DRAWINGS

The invention is described below in detail by making reference to the enclosed drawings that illustrate some embodiments of the invention.

DESCRIPTION OF THE PREFERRED EMBODIMENTS

Figure 1:
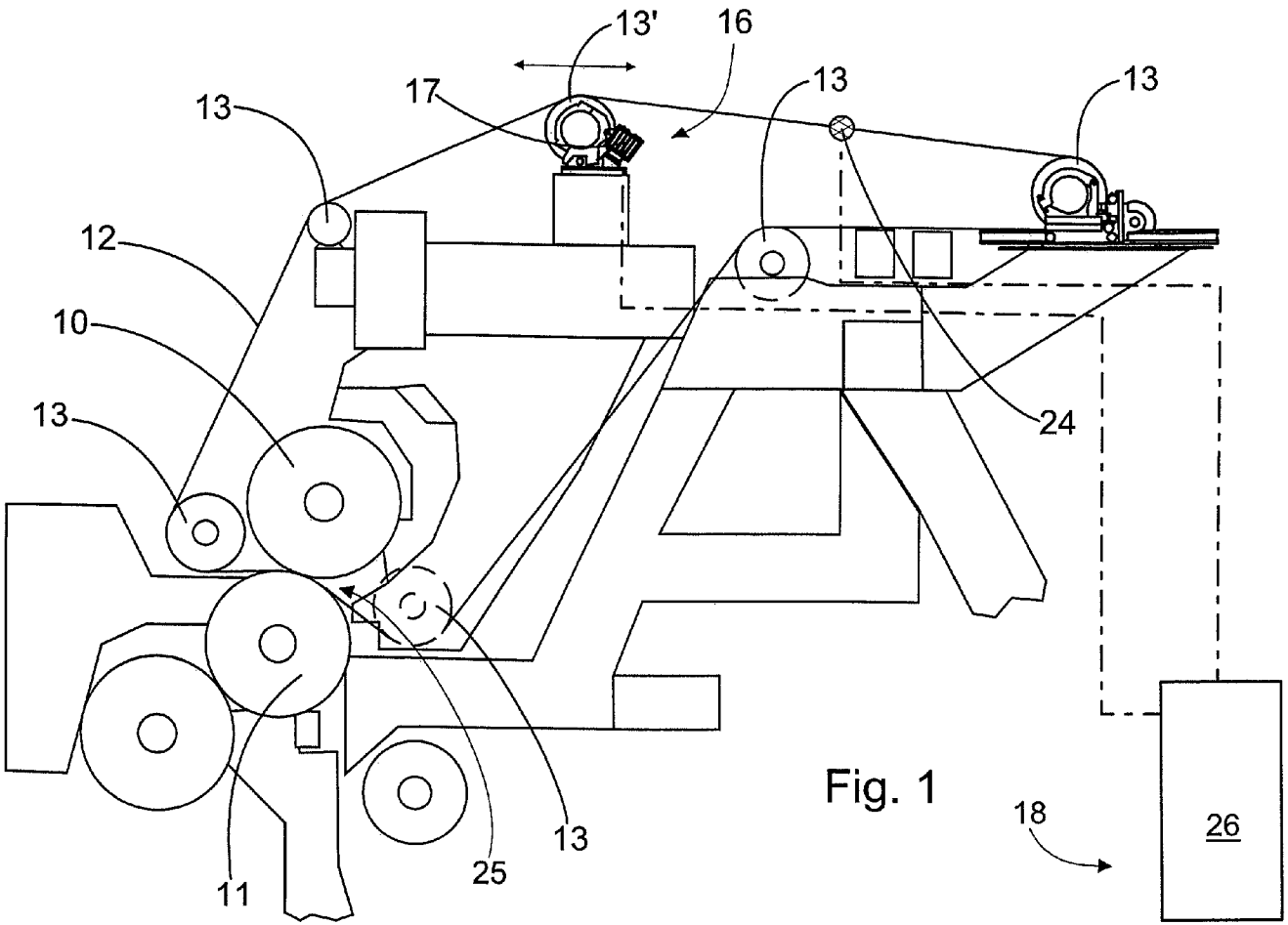
FIG. 1 shows a part of the press section of a fiber web machine, provided with the arrangement according to the invention.

FIG. 1 shows the press section of a fiber web machine. This concept has two press nips, the upper one of which is formed between two rolls 10 and 11. A press fabric, most generally a fabric 12, which is supported by guide rolls 13 and 13', is also arranged to run through the said press nip. The press fabric is typically a press felt, which is in contact with the wet web. In other words, the fabric belonging to the fiber web machine supports the web produced by the fiber web machine. The web 14 is shown only in FIG. 2. The arrangement also comprises actuators 16 for changing the location of the fabric 12 in the cross direction CD of the fiber web machine. In other words, the method is used for changing the location of the fabric 12 in the cross direction CD of the fiber web machine.

The actuators typically consist of a fabric guide 17, which is arranged in conjunction with one guide roll 13'. The actuators can be used for shifting the end of a roll for example ±60 mm, but in practice the guide roll only moves a few millimeters in guide use. In guide use, the fabric guide keeps the fabric at the desired point with respect to the center line or edge of the fiber web machine. The fabric guide can also be oscillated, in which case the location of the fabric is changed intentionally in the cross direction of the fiber web machine. The arrangement also comprises control devices 18 combined with the actuators 16. The control devices follow the fabric and use, wherever necessary, the actuators for guiding and/or oscillating the fabric.

According to the invention, the control devices 18 are arranged to operate the actuators 16 in an oscillating manner. Moreover, the oscillation amplitude 19 is adapted to be kept so high that the area of impact 20 of the web 14 on the fabric 12 is wider than the width 21 of the web 14 throughout the lifetime of the fabric 12.

In other words, according to the invention the location of the fabric is changed by means of oscillation, the amplitude 19 of which is kept so high that the area of impact 20 of the web 14 on the fabric 12 is wider than the width 21 of the web 14 throughout the lifetime of the fabric 12. In this case, the web is always on such an area of the fabric on which it has already been. This avoids the edge of the web going onto an area where it has never been or where it has not been for a long time. In this way, it is possible to avoid damage to the edge of the web and consequently to prevent at least some web breaks.

Figure 2:
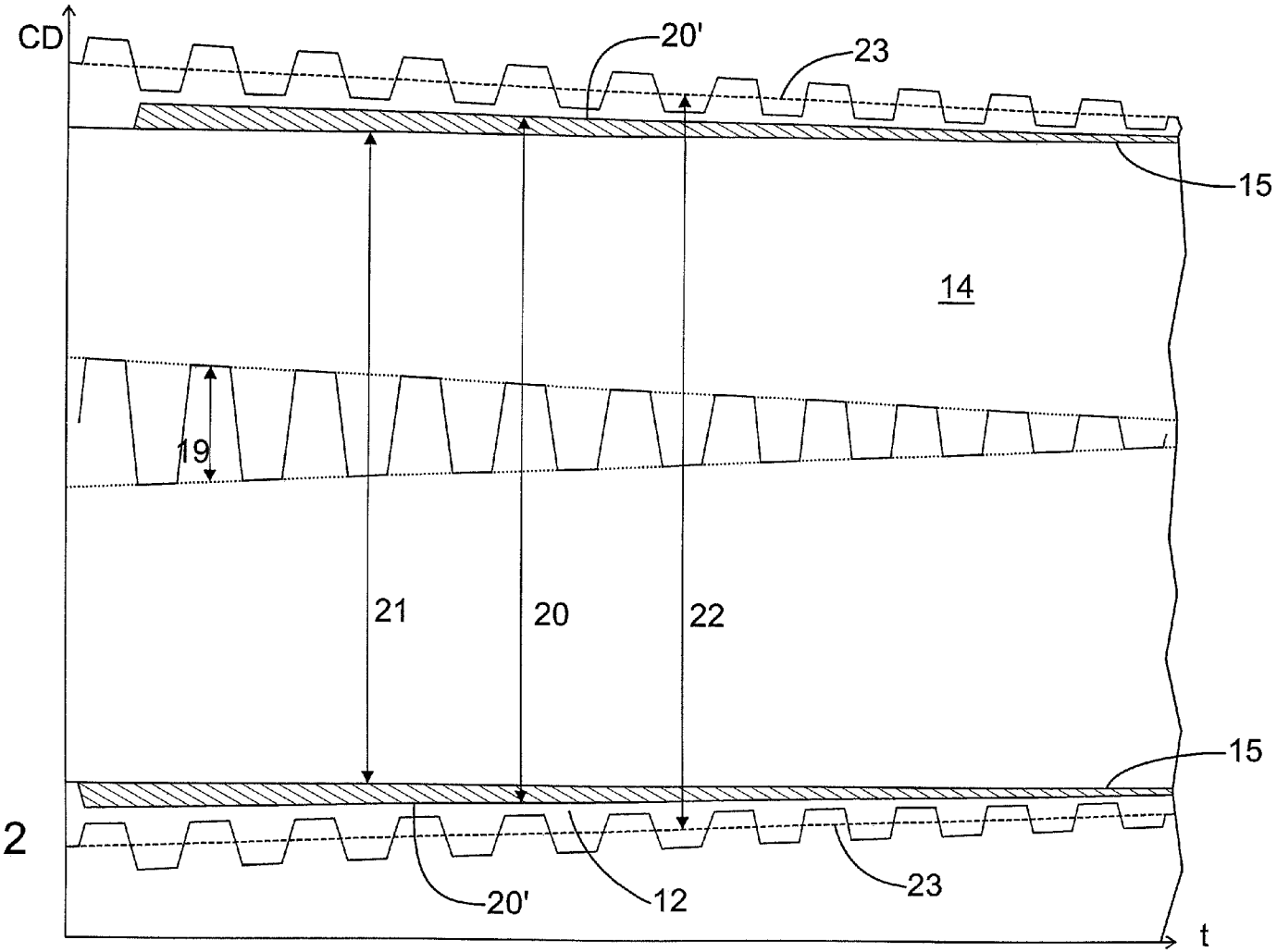
FIG. 2 is a chart showing the principle of the method according to the invention.

FIG. 2 shows the web 14 and fabric 12 when the fabric is oscillated. The X-axis shows the time and the Y-axis shows the cross direction CD of the fiber web machine. For example paper and board machines are fiber web machines. FIG. 2 presents the behavior of the fabric 12 during its lifetime. For clarity, the lifetime of the fabric is presented in a different scale than the oscillation of the fabric, which is described by the step graph in the middle. Moreover, the oscillation graph has been exaggerated in relation to the movements of the edge of the fabric so that the amplitude changes would stand out more clearly. In practice, the lifetime of the fabric can be several weeks, while in the oscillation of the fabric the periods of time are typically minutes or hours. In this case, there can be hundreds of oscillation cycles during the lifetime of the fabric, although only a dozen or so oscillation cycles are presented in FIG. 2. The area with oblique lines represents the area of impact 20 of the web 14 on the fabric 12. Naturally, this area comprises the entire area covered by the web and the areas affected by oscillation. In the case of a press felt, the fabric is affected when it passes through the press nip together with the web. In this case, the felt becomes denser in the said area, while the outside areas remain thicker. This may cause a point of discontinuity in the fabric. The method according to the invention can prevent the web from hitting such a point of discontinuity, thereby preventing web breaks. Correspondingly, a fabric area which has not been affected by the web for a long time may be contaminated in a different way, or the fabric at the boundary of the affected and unaffected areas is frayed. This also causes a point of discontinuity, and the web hitting such a point can now be avoided by means of oscillation.

According to the invention, the oscillation amplitude 19 is changed constantly in proportion to the width 22 of the fabric 12. In other words, changes in the width of the fabric are taken into account. FIG. 2 shows the width 22 of the fabric 12, and the edges 23 of the fabric 12 are denoted by the broken line, which shows the average location of the edges in the middle of the oscillating movement of the edges. As the fabric becomes wider, the oscillation amplitude can be increased and according to the invention it actually needs to be increased so that the area affected by the web on the fabric remains sufficiently large. Correspondingly, the amplitude is reduced as the fabric becomes narrower. The width of the fabric may change for various reasons, and during the lifetime of the fabric, it tends to become narrower. Dynamic changes in the width are caused, among other things, by so-called splice turning, in which the direction of the seam in the fabric is changed intentionally. By offsetting the perpendicular splice, the fabric becomes narrower. This is also taken into account in the oscillation, whereby edge damage can be avoided. In order to accomplish this function, the arrangement further comprises sensors 24 for determining the width of the fabric 12, with the sensors 24 having a feedback connection to the control devices 18. In this way, the entire arrangement adapts to each operating situation, and splice turning and oscillation can be utilized without fear of extra web breaks.

Furthermore, the method takes into account the recession of the web from the unused area of the fabric as the fabric gets older. The reason for this is that the oscillation amplitude 19 is reduced during the lifetime of the fabric 12 so that the edge 15 of the web 14 gets farther from the outside edge 20' of the area of impact 20 of the web 14. In FIG. 2, the reduction in oscillation can be seen from the smaller shift distance of the edge of the fabric and from the reduced step graph in the middle, describing the amplitude.

In prior art, the fabric is run slowly back and forth continuously. This leads to a situation where the outermost parts of the area of impact of the web are not affected sufficiently, whereby the extreme edges of oscillation are most susceptible to cause a fault at the edge of the web. Moreover, the fabric goes over these areas frequently and regardless of the other factors influencing the width of the fabric. Instead, according to the present invention, the location of the fabric 12 is changed rapidly in oscillation from one side of the fiber web machine to the other. This maximizes the period of time during which the web affects the edge areas of the fabric. The effect is enhanced when, after the change from one side to the other, the fabric 12 is kept at the side in question before the next change of side. This results in the step graph shown in FIG. 2. Furthermore, it is possible that there is small-amplitude oscillation while the fabric is kept at one side. This small motion is not shown in the graph in FIG. 2.

The oscillation according to the method can be scaled as required by the individual case and it can hence be adjusted dynamically as necessary. Generally speaking, a quick change of sides takes 2 to 15, preferably 4 to 10 minutes. Similarly, the fabric is kept at one side for 0.5 to 12.0, more preferably for 0.75 to 6.0 hours. In any case, the change of sides takes much less time than what the fabric is kept at one side, whereby the edge areas of the fabric are certainly affected by the web.

Many press applications use two press felts 12, which travel through the same press nip 25, as the fabric 12. In this case, the web runs through the press nip between two press felts. According to the invention, the oscillations of both press felts are synchronized, whereby the fabrics are affected evenly. The synchronization can be carried out so that the oscillations run at the same pace. Oscillations in opposite paces are also possible. Perhaps the best option is to synchronize the oscillations to have overlapping and opposing paces, whereby the web does not hit, not at least simultaneously, the points of discontinuity in both fabrics. However, it is unlikely that the web hits the points of discontinuity in both fabrics if the oscillation is adjusted and if oscillation has been used according to the invention from the beginning.

In the method according to the invention, the fabric is oscillated dynamically on the basis of the width of the fabric. In other words, changes in the width of the fabric are taken into account knowingly. The oscillation is preferably automatic, in which case the arrangement adapts to changes in the conditions and in particular to changes in the properties of the fabric, especially changes in width. The oscillation and the width measurement of the fabric can be done using for example an existing fabric guide device with the manufacturer's trade name UltraEdge. The fabric guide device can be connected for example to the machine control system 26 of the fiber web machine, which machine control system incorporates a software product that comprises the program code elements arranged to perform the steps of the method according to the invention. In advanced devices, the software product can be incorporated into the fabric guide device.

By making use of the method and arrangement according to the invention, web breaks are reduced substantially, because issues such as the shifting of the edge of the web to outside the earlier area of impact of the web as a result of natural width changes in the fabric can be avoided. In the press section, factors such as changes in the vacuum levels of suction rolls, changes in the nip load, moisture changes, splice turning, and the typical narrowing of the press felt itself during its lifetime cause both fast and slow changes in the width of the press felt. In general terms, there is a constant and often fast change in the width of the fabric, which is why dynamic and automatic response, in other words adjustment of oscillation and its amplitude in accordance with the invention, is important.

When the theory of the invention was tested in practice, it was noticed that the theory is valid. When the measurement data was combined in retrospect, it was found that the convergence of the edges of the fabric and web often coincides with a web break. The convergence may be affected by changes in the fabric, splice turning, and the oscillation of the fabrics together and/or separately. By using the method and arrangement according to the invention, it is possible to avoid such problems, where the edge of the web goes onto an unused area of the fabric or onto an area of the fabric that has not been used for a length of time, and this in turn reduces web breaks significantly. In practice, it is possible to avoid the problems by an automatic change to the oscillation amplitude of the fabric, where the change corresponds to the change in the width of the fabric. At the same time, the splice turning device can be operated by only monitoring the vibrations. In other words, splice turning can be performed on the basis of the vibrations when the fabric guide makes sure that the edge of the web never goes too close to the edge of the fabric and when the edge areas of the fabric are affected by the web from the beginning.

In practice, at the beginning of the lifetime of the fabric, the oscillation must be so great that the area affected/worn by the web as a result of the oscillation throughout the lifetime of the fabric is wider than the width of the web in a situation where the fabric is at its narrowest. In this case, the web never goes onto the unaffected/unworn area. Moreover, the oscillation is reduced slowly from the value calculated on the basis of the width of the fabric so that the oscillated area becomes narrower throughout the lifetime of the fabric. In this way, the edge of the web moves away from the unaffected/unworn area throughout the lifetime of the fabric.

It should be understood that where actuators, control devices, or sensors, are referred to the use of a singular device is also included.

In practice, the dynamic automatic oscillation of the fabric on the basis of the width of the fabric can be carried out for example as follows: The width of a new fabric is 10,000 mm, and the oscillation amplitude is for example 70 mm. This means that the maximum distance between the edges of the fabric is 10,070 mm. The width of the web remains substantially constant. During operation, the fabric may become for example 50 mm narrower, in which case the width of the fabric is 9,950 mm. The narrowing of the fabric is taken into account by reducing the oscillation to the same degree. In this case, the oscillation amplitude is set to 20 mm. The necessary change in the amplitude also depends on the narrowness of the web, in other words on the relationship between the widths of the fabric and web. Alongside a long-term change, the arrangement also adapts to momentary and rapid changes in the width of the fabric.

We claim:

1. A method in a fiber web machine, comprising the steps of:

producing on a fabric, a fiber web having two edges and a selected width between said edges, the edges defining therebetween a cross direction of the fiber web machine;

changing the location of the fabric with respect to the fiber web by oscillating the fabric in the cross direction with a selected amplitude of cross machine direction movements so that the fabric is affected by wear over a width which is wider than the fiber web;

wherein the fiber web as supported on the fabric as the fabric oscillates defines two portions of the fabric, a fiber web affected area on the fabric where the fiber web is supported on said fabric, and portions of the fabric outside of the fiber web affected area;

wherein the fiber web affected area has a cross direction width, the fiber web affected area being bounded on either side by outside edges;

controlling the amplitude of cross machine direction movement such that the width of the fiber web affected area is wider than the width of the fiber web, and so that as the fabric changes in width in the cross direction during operation, and the fiber web remains substantially of constant width, the fiber web does not cross between the fiber web affected area and the portions of the fabric outside of the fiber web affected area.

2. The method of claim 1 wherein the fabric continuously narrows in the cross direction.

3. The method of claim 1 wherein the oscillation amplitude is changed constantly in proportion to the width of the fabric.

4. The method of claim 1 wherein the fiber web machine defines a first side and a second side, and location of the fabric oscillates from the first side of the fiber web machine to the second side of the web machine with respect to the fiber web, and wherein the fabric is kept at the first side before change to the second side where the fabric is kept before change to the first side.

5. The method of claim 4 wherein the fabric undergoes small-amplitude oscillation while the fabric is kept at said first side, and said second side.

6. The method of claim 4 wherein the fabric is kept at one side for 0.5 to 12.0 hours.

7. The method of claim 6 wherein the fabric is kept at one side for 0.75 to 6.0 hours.

8. The method of claim 1 wherein the fabric oscillates from the first side to the second side over 2 to 15 minutes.

9. The method of claim 8 wherein the fabric oscillates from the first side to the second side over 4 to 10 minutes.

10. The method of claim 1 wherein the fabric is one of two press felts which travel together through a press nip along with the fiber web, and wherein both the press felts are oscillated, and wherein the oscillations of both press felts are synchronized.

11. An arrangement in a fiber web machine processing a fiber web, wherein the arrangement comprises:

a fabric engaging the fiber web, the fabric having a width, and wherein the fabric is subject to change in width in a cross direction of the fiber web machine;

actuators in the fiber web machine arranged to change the location of the fabric in the cross direction of the fiber web machine to create a fiber web affected area wider than the fiber web by oscillating the fabric at selected amplitudes;

wherein the fiber web affected area defines portions of the fabric outside of the fiber web affected area;

control devices connected in controlling relation to the actuators; and wherein the control devices are arranged to operate the actuators such that the oscillating caused by the actuators decreases in magnitude such that the fiber web affected area only decreases while remaining wider than the width of the fiber web as the fabric width changes, and so that the portions of the fabric outside of the fiber web affected area do not engage the fiber web.

12. The arrangement of claim 11 further comprising sensors for determining the width of the fabric wherein the sensors have a feedback connection to the control devices.

13. The arrangement of claim 11 wherein the control devices have a software with program code elements to carry out the steps of:

changing the location of the fabric with respect to the fiber web by oscillating the fabric in the cross direction with the selected amplitude of cross machine direction movements such that the fabric is affected by wear over a width which is wider than the fiber web, and such that the amplitude of cross machine direction movements are decreased over time such that the width of the area defined by impact of a fiber web on the fabric is wider than a width defined by the fiber web, so that as the fabric width decreases in the cross direction with use, and the fiber web remains substantially of constant width, the fiber web does not engage portions of the fabric outside of the fiber web affected area.

* * * * *